US008371689B2

(12) United States Patent
Izawa et al.

(10) Patent No.: US 8,371,689 B2
(45) Date of Patent: Feb. 12, 2013

(54) INK-JET RECORDING APPARATUS

(75) Inventors: Hideo Izawa, Chiba (JP); Akira Ishikawa, Chiba (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 169 days.

(21) Appl. No.: 12/927,485

(22) Filed: Nov. 16, 2010

(65) Prior Publication Data

US 2011/0249067 A1 Oct. 13, 2011

(30) Foreign Application Priority Data

Apr. 9, 2010 (JP) ..... 2010-90782

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

2002/0105571 A1* 8/2002 Izawa et al. ..... 347/104

* cited by examiner

*Primary Examiner* — Stephen Meier
*Assistant Examiner* — Tracey McMillion
(74) *Attorney, Agent, or Firm* — Flynn, Thiel, Boutell & Tanis, P.C.

(57) ABSTRACT

The present invention is an ink-jet recording apparatus 100 capable of carrying out printing continuously onto both surfaces of a recording medium 1, the ink-jet recording apparatus 100 having: a first unit 10*a* having a first ink-jet recording head 2*a* for carrying out printing onto a first surface la of the recording medium 1 and having a first drying drum 3*a*positioned below the first ink-jet recording head 2*a* and heating and drying the recording medium 1 after the printing; and a second unit 10*b* having a second ink-jet recording head 2*b* for carrying out printing onto a second surface 1*b* of the recording medium 1 and having a second drying drum 3*b* positioned below the second ink-jet recording head 2*b* and heating and drying the recording medium 1 after the printing.

7 Claims, 4 Drawing Sheets

INK-JET RECORDING APPARATUS

TECHNICAL FIELD

The present invention relates to an ink-jet recording apparatus and, more particularly, relates to an ink-jet recording apparatus capable of suppressing the contamination of a recording medium, efficiently utilizing installation space, and carrying out continuous printing onto both surfaces of the recording medium.

BACKGROUND ART

Generally, an ink-jet recording method is used in many fields since desired designs and characters can be printed.

Recently, a recording medium having both surfaces on which designs or characters are printed by the ink-jet recording method is desired.

Examples of the method of carrying out printing on both surfaces of a recording medium by the ink-jet recording method include a batch-type method in which printing is carried out twice by the same ink-jet recording apparatus.

In this method, for example, printing is carried out on one of the surfaces of the recording medium by the ink-jet recording method, the recording medium is then reversed, and printing is carried out on the other surface of the recording medium by the ink-jet recording method.

However, in this batch-type method, if the medium is not dried once, the image thereon may be blurred since a large amount of ink has to be applied depending on the design thereof. Therefore, continuous printing cannot be carried out, and the method lacks productivity.

On the other hand, an ink-jet recording apparatus having two printing units and a drier(s) is known (for example, see Patent Document 1 or 2).

According to the ink-jet recording apparatus, printing on both surfaces of a recording medium can be continuously carried out.

CONVENTIONAL ART DOCUMENTS

Patent Documents

Patent Document 1 Japanese Patent Application Laid-Open Publication No. 09-240068

Patent Document 2 Japanese Unexamined Patent Application Publication No. 2002-234214

SUMMARY OF THE INVENTION

Problems to be Solved by the Invention

However, the both-side printing apparatus of above described Patent Document 1 has a drawback that large installation space is inevitably required since a high-frequency drier is used.

On the other hand, in the both-side printing apparatus of above described Patent Document 2, since the printing units are disposed at upper and lower locations in one section, ink may be scattered, and the recording medium may be contaminated by the floating ink.

The present invention has been accomplished in view of the Foregoing circumstances, and it is an object of the present invention to provide an ink-jet recording apparatus capable of suppressing the contamination of a recording medium, efficiently utilizing installation space, and carrying out continuous printing onto both surfaces of the recording medium.

Means for Solving the Problems

The present inventor has diligently carried out studies in order to solve the above described problems and found out that the above described problems can be solved by using drying drums as dryers so as to improve the efficiency of the installation space and making consideration for the traveling direction of a recording medium, thereby accomplished the present invention.

Specifically, the present invention resides in (1) an ink-jet recording apparatus capable of carrying out printing continuously onto both surfaces of a recording medium, the ink-jet recording apparatus having: a first unit having a first ink-jet recording head for carrying out printing onto a first surface of the recording medium and having a first drying drum positioned below the first ink-jet recording head and heating and drying the recording medium after the printing; and a second unit having a second ink-jet recording head for carrying out printing onto a second surface of the recording medium and having a second drying drum positioned below the second ink-jet recording head and heating and drying the recording medium after the printing; wherein the first unit and the second unit are adjacent to each other; in the first unit, the first surface is subjected to the printing when the recording medium travels from the second unit side toward an opposite side; in the second unit, the second surface is subjected to the printing when the recording medium travels from the first unit side toward an opposite side; and the recording medium can continuously travel in the first unit and the second unit.

The present invention resides in (2) the ink-jet recording apparatus according to above described (1), wherein a first boundary wall and a second boundary wall are provided between the first unit and the second unit; and a gap passage for allowing passage of the recording medium is provided in a part in which the first boundary wall and the second boundary wall are overlapped with each other.

The present invention resides in (3) the ink-jet recording apparatus according to above described (2), wherein a guiding roll immediately before guiding the recording medium to the gap passage can be moved up and down.

The present invention resides in (4) the ink-jet recording apparatus according to above described (1), wherein housing space is provided between the first drying drum and the second drying drum.

The present invention resides in (5) the ink-jet recording apparatus according to above described (4), wherein an ink tank is housed in the housing space, and an ink is supplied from the ink tank to the first ink-jet recording head and the second ink-jet recording head.

The present invention resides in (6) the ink-jet recording apparatus according to above described (1), wherein the first ink-jet recording head and the second ink-jet recording head are provided at a same height.

The present invention resides in (7) the ink-jet recording apparatus according to above described (2), wherein the first unit and the second unit both have a shape of turned L and are symmetrical with respect to the first boundary wall and the second boundary wall.

The present invention resides in (8) the ink-jet recording apparatus according to above described (1), wherein a suction device is attached to each of an entrance-side sidewall of a first frame wall of the first unit and an exit-side sidewall of a second frame wall of the second unit.

Effects of the Invention

In the ink-jet recording apparatus of the present invention, the first surface of the recording medium is subjected to printing in the first unit and then dried by the first drying drum, and the second surface of the recording medium is subjected to printing in the second unit and then dried by the second drying drum. Therefore, even in the case of a print design that requires a large amount of ink application, blur of the image is suppressed since the recording medium is dried by the drying drums. Moreover, since the first unit and the second unit are adjacent to each other, printing can be carried out continuously onto both surfaces of the recording medium by the path from which an unnecessary part is eliminated as much as possible.

In the above described ink-jet recording apparatus, the first surface is configured to be subjected to printing in the first unit while the recording medium travels from the second unit side toward the opposite side, and the second surface is configured to be subjected to printing in the second unit while the recording medium travels from the first unit side toward the opposite side; consequently, an accompanying current generated upon traveling of the recording medium involves the vaporous floating ink floating in the air and brings the floating ink to the opposite side of the unit. Therefore, contamination of the adjacent unit can be suppressed. When the walls are provided between the first unit and the second unit, contamination of the recording medium can be reliably suppressed.

When the suction device is attached to each of the entrance-side sidewall of the first frame wall of the first unit and the exit-side sidewall of the second frame wall of the second unit, the floating ink is sucked in by the suction devices, thereby reliably suppressing the contamination caused by the floating ink.

In the above described ink-jet recording apparatus, the installation space can be downsized by disposing the drying drums below the ink-jet recording heads. Thus, the housing space can be provided between the first drying drum and the second drying drum. For example, when the first unit and the second unit both have the shape of a turned L, a wider housing space can be provided.

In the housing space, auxiliary equipment such as ink tanks and a control board can be disposed.

In the above described ink-jet recording apparatus, when the first ink-jet recording head and the second ink-jet recording head are provided at the same height, uniform operability and workability can be ensured. When the constitutions thereof are also the same, assembly is easy, and production cost of the parts thereof can be reduced.

MODES FOR CARRYING OUT THE INVENTION

Figure 1:
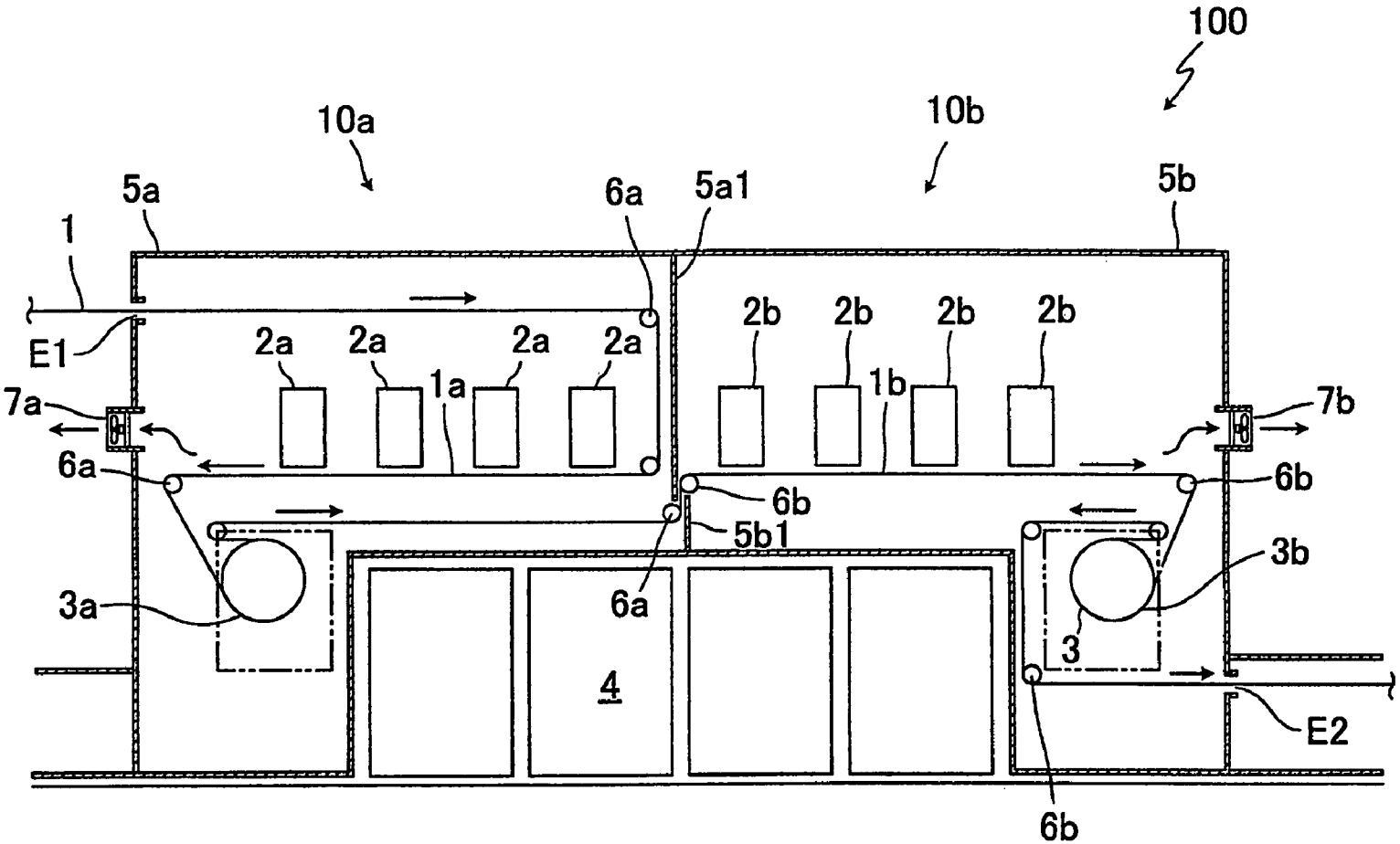
FIG. 1 is a schematic drawing showing an example of an ink-jet recording apparatus according to the present embodiment.

Hereinafter, a preferred embodiment of the present invention will be explained in detail with reference to the drawings if needed. Note that, in the drawings, the same elements are denoted by the same reference numerals, and redundant explanations thereof are omitted. Moreover, unless otherwise stated, the positional relations such as top, bottom, left, and right are based on the positional relations shown in the drawings. Furthermore, the dimensional ratios of the drawings are not limited to the ratios shown in the drawings.

FIG. 1 is a schematic drawing showing an example of an ink-jet recording apparatus according to a present embodiment.

As shown in FIG. 1, the ink-jet recording apparatus 100 of the present invention has a first unit 10*a* for carrying out printing onto a first surface 1*a* of a recording medium 1 and a second unit 10*b* for carrying out printing onto a second surface 1*b* of the recording medium 1. Therefore, according to the above described ink-jet recording apparatus 100, printing can be carried out continuously onto both surfaces of the recording medium 1.

The first unit 10*a* and the second unit 10*b* are adjacent to each other so as to be approximately laterally symmetrical. Therefore, the conveyance of the recording medium 1 from the first unit 10*a* to the second unit 10*b* is carried out by a path from which unnecessary part is eliminated as much as possible. Moreover, assembling and maintenance management of the entire apparatus is easy.

The first unit 10*a* and the second unit 10*b* both have the shape of a turned L. Therefore, as is described later, when the first unit 10*a* and the second unit 10*b* are adjacent to each other, housing space 4 is formed at a center lower part.

The first unit 10*a* has: first ink-jet recording heads 2*a* which carry out printing onto the first surface 1*a* of the recording medium 1, a first drying drum 3*a* which is positioned below the first ink-jet recording heads 2*a* and heats and dries the recording medium 1 after printing, and a first frame wall 5*a* surrounding them. The first drying drum 3*a* is disposed at a position (entrance side) away from the second unit 10*b*. Thus, the first ink-jet recording heads 2*a* and the first drying drum 3*a* below them form a turned L shape.

The second unit 10*b* has: second ink-jet recording heads 2*b* which carry out printing onto the second surface 1*b* of the recording medium 1, a second drying drum 3*b* which is positioned below the second ink-jet recording heads 2*b* and heats and dries the recording medium 1 after printing, and a second frame wall 5*b* surrounding them. The second drying drum 3*b* is disposed at a position (exit side) away from the first unit 10*a*. Thus, the second ink-jet recording heads 2*b* and the first drying drum 3*b* below them form a turned L-shape.

On the first frame wall 5*a* of the first unit 10*a*, a suction device 7*a* is attached to the sidewall thereof of the entrance side; and, on the second frame wall 5*b* of the second unit 10*b*, a suction device 7*b* is attached to the sidewall thereof of the exit side.

These suction devices 7*a* and 7*b* are configured to suck in the floating ink (ink mist), which will be described later. Note that, since filters are attached to the suction devices 7*a* and 7*b*, not only the interior of the frame wall but also outside of the frame wall can be prevented from being contaminated.

The first ink-jet recording heads 2*a* are disposed in four rows, and each of them houses ink. Note that the inks may have mutually the same colors or different colors. For example, when yellow, magenta, cyan, and black are housed, full colors can be expressed.

The second ink-jet recording heads 2*b* have the same structures as the first ink-jet recording heads 2*a*. However, the inks used therein may be the same or different. Also, the print designs to be recorded onto the recording medium 1 may be different between the first surface 1*a* and the second surface 1*b*.

Herein, the first ink-jet recording heads 2*a* of the first unit 10*a* and the second ink-jet recording heads 2*b* of the second unit 10*b* are provided at the same height. Therefore, uniform operability and workability is ensured. Moreover, since the constituent parts thereof are the same, assembly is easy, and production cost of the apparatus can be reduced.

As described above, the first drying drum 3*a* is disposed below the first ink-jet recording head 2*a*. As a result, the installation space of the first unit 10*a* can be downsized.

The first drying drum 3*a* has a heating heater in the interior thereof, and the surface of the drum is configured to be heated by the heat. Moreover, the first drying drum 3*a* is provided with a blowing nozzle, which is not shown, and the blowing nozzle is configured to blow hot air onto the surface of the first drying drum 3*a*. Thus, the first drying drum 3*a* is configured to dry the print surface of the recording medium, which is wound around the surface of the first drying drum 3*a*, by these two drying functions. Note that the second drying drum 3*b* has the same structure as the first drying drum 3*a*.

Figure 2:
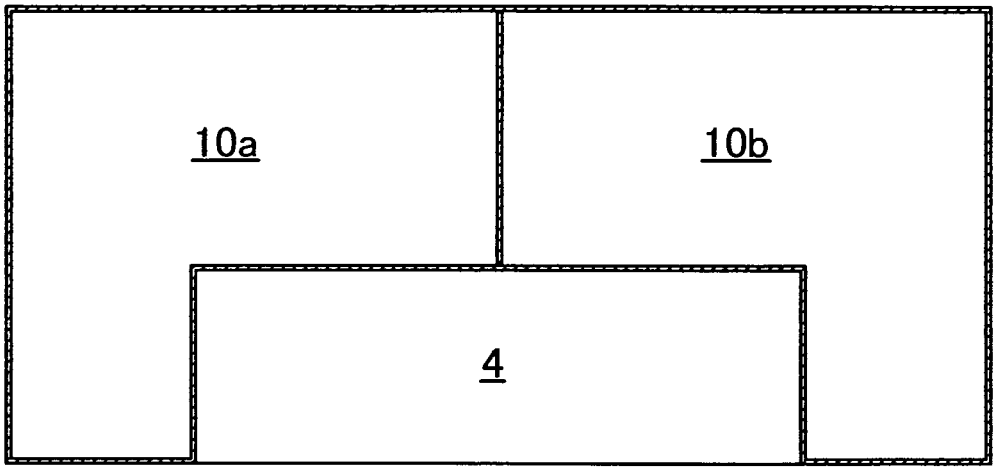
FIG. 2 is a schematic drawing for explaining the arrangement of the units of the ink-jet recording apparatus according to the present embodiment.

FIG. 2 is a schematic drawing for explaining the arrangement of the units of the ink-jet recording apparatus according to the present embodiment.

As shown in FIG. 2, in the ink-jet recording apparatus, the housing space 4 is formed at the center lower part by disposing the first unit 10*a* and the second unit 10*b*, which have turned L shapes, so that the units are opposed to each other. In other words, the housing space 4 is provided between the first drying drum 3*a* and the second drying drum 3*b*.

In the housing space 4, auxiliary equipment such as ink tanks and a control board is disposed. By virtue of this, the installation space as a whole apparatus can be efficiently utilized. Moreover, the first unit 10*a* and the second unit 10*b* are approximately laterally symmetric to each other with respect to a first boundary wall and a second boundary wall, which will be described later; therefore, for example, the ink tanks disposed in the housing space 4 can be utilized in common by the first unit 10*a* and the second unit 10*b*. In that case, the operation of supplying ink from the ink tanks to the first ink-jet recording heads 2*a* and the second ink-jet recording heads 2*b* is facilitated.

Returning to FIG. 1, in the ink-jet recording apparatus 100 according to the present embodiment, the first boundary wall 5*a*1 and the second boundary wall 5*b*1 are provided between the first unit 10*a* and the second unit 10*b*, in other words, at the boundary. In other words, the first unit 10*a* and the second unit 10*b* are sectioned by the first boundary wall 5*a*1 and the second boundary wall 5*b*1.

Figure 3:
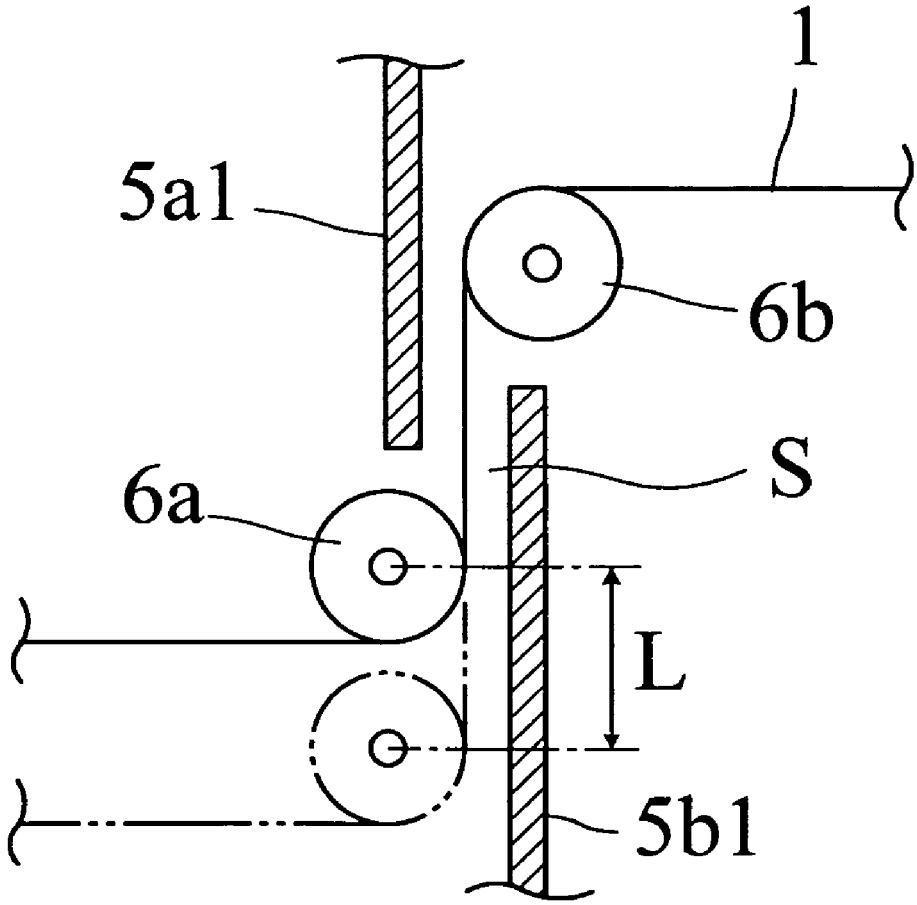
FIG. 3 is a partial cross sectional view which is an enlarged partial view of a first boundary wall and a second boundary wall in the ink-jet recording apparatus according to the present embodiment.

FIG. 3 is a partial cross sectional view which is an enlarged partial view of the first boundary wall and the second boundary wall in the ink-jet recording apparatus according to the present embodiment.

As shown in FIG. 3, the first boundary wall 5*a*1 and the second boundary wall 5*b*1 are partially overlapped with each other. The recording medium 1 is configured to pass through a gap passage S of the overlapped part.

In the ink-jet recording apparatus 100, the first boundary wall 5*a*1 and the second boundary wall 5*b*1 are provided; therefore, the first unit 10*a* and the second unit 10*b* are sectioned, and the mutual influence in the printing environments thereof such as temperatures and humidity using air conditioning can be suppressed as much as possible. In other words, the printing environment of each of the first unit 10*a* and the second unit 10*b* can be caused to be independent.

Moreover, the walls have the structure in which the distal ends of the first boundary wall 5*a*1 and the second boundary wall 5*b*1 are overlapped with each other alternately; therefore, for example, in the first unit 10*a*, migration of the floating ink to the second unit 10*b* can be suppressed more. Thus, contamination of the recording medium that is in the adjacent unit can be reliably suppressed.

Herein, a guiding roll 6*a* which directly guides the recording medium 1 to the gap passage S can be moved up and down. Therefore, the conveyance path length of the recording medium 1 can be changed, and a function as a compensator that adjusts the both-side printing register by the amount of the length L (see two-dot chain line) is exerted.

Returning to FIG. 1, in the ink-jet recording apparatus 100 according to the present embodiment, the recording medium 1 is configured to travel continuously.

The recording medium 1 carried into the first unit 10*a* of the ink-jet recording apparatus 100 is carried thereinto from the entrance E1 and once passes above the first ink-jet recording heads 2*a*. Then, the recording medium is guided downward by a guiding roll 6*a* in front of the first boundary wall 5*a*1 and reaches a region in which the medium is subjected to printing by the first ink-jet recording heads 2*a* (hereinafter, referred to as "recordable region"). At this point, the first surface 1*a* of the recording medium 1 is subjected to printing sequentially by the first ink-jet recording heads 2*a*. In other words, in the first unit 10*a*, the first surface 1*a* of the recording medium 1 is subjected to printing while the recording medium 1 travels from the second unit 10*b*-side toward the opposite side.

Then, the recording medium 1 is guided to the first drying drum 3*a* below by a guiding roll 6*a*, is wound around the drum circumference of the first drying drum 3*a* so as to approximately go around the circumference, and is dried. At this point, the opposite side of the printed surface 1*a* of the recording medium 1 is configured to be brought into contact with the drum. Thus, the recording medium 1 is efficiently dried, and contamination of the drum is also suppressed.

The dried recording medium 1 is guided upward from the first unit 10*a* through the gap passage S via the guiding roll 6*a* and carried to the second unit 10*b*. Note that, as described above, the guiding roll 6*a* that directly guides the recording medium 1 to the gap passage S can be moved up and down.

The recording medium 1 carried into the second unit 10*b* reaches the recordable region of the ink-jet recording heads 2*b*, and the second surface 1*b* is subjected to printing. In other words, in the second unit 10*b*, the second surface 1*b* is subjected to printing while the recording medium 1 travels from the first unit 10*a*-side toward the opposite side.

Then, the recording medium 1 is guided to the second drying drum 3*b* below them by a guiding roll 6*b*. Then, the recording medium is wound around the drum circumference of the second drying drum 3*b* so as to approximately go around the circumference and is dried. At this point, the opposite side of the printed surface 1*b* of the recording medium 1 is configured to be brought into contact with the drum. Thus, as described above, the recording medium 1 is efficiently dried, and contamination of the drum is also suppressed.

The dried recording medium 1 is carried out from the exit E2 via a guiding roll 6*b*.

Figure 4:
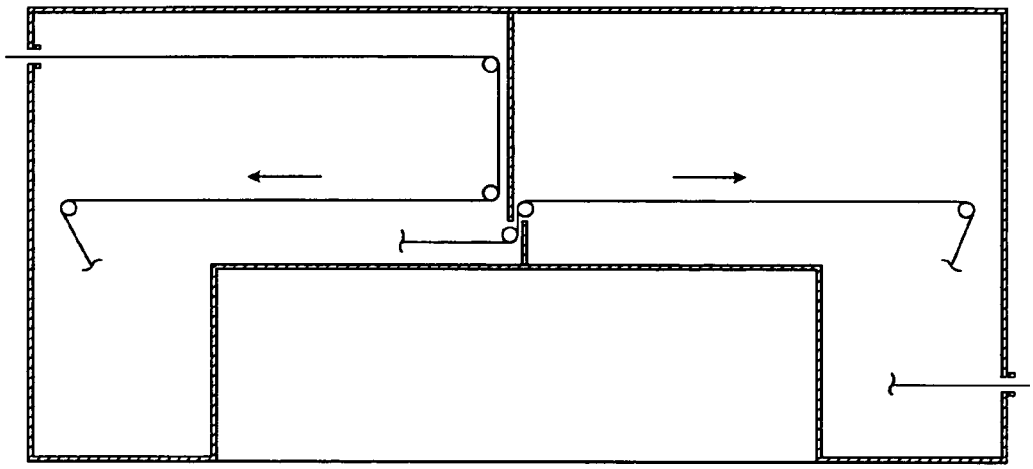
FIG. 4 is a schematic drawing showing the traveling direction of a recording medium upon printing onto the recording medium in the ink-jet recording apparatus according to the present embodiment.

FIG. 4 is a schematic drawing showing the traveling direction of the recording medium upon printing onto the recording medium in the ink-jet recording apparatus according to the present embodiment.

As shown in FIG. 4, in the first unit 10*a*, the recording medium 1 travels from the second unit 10*b*-side toward the side opposite thereto; therefore, the accompanying flow generated upon travelling of the recording medium 1 acts so that the floating ink in the air accompanies the flow toward the side opposite to the second unit 10*b*. Note that, when the floating vaporous ink adheres, contamination color spots are developed even when the volume thereof is ultralow. Thus, the ink floating in the first unit 10*a* can be prevented from migrating to the second unit 10*b*, and contamination of the second unit 10*b* is suppressed.

Note that, if the traveling direction of the recording medium 1 upon printing onto the recording medium 1 in the first unit 10*a* is the direction toward the second unit 10*b*, the accompanying flow involves the floating ink and brings the ink into the second unit 10*b*.

Herein, the suction device 7*a* is attached to the sidewall of the entrance side of the first frame wall 5*a* of the first unit 10*a*. Therefore, contamination caused by the floating ink can be reliably suppressed by sucking in the floating ink by the suction device.

In the second unit 10*b*, the recording medium 1 travels from the first unit 10*a*-side toward the opposite side; therefore, in the same manner as that described above, the accompanying flow generated upon traveling of the recording medium 1 involves the floating ink in the air and brings the floating ink toward the side opposite to the first unit 10*a*. Thus, the floating ink in the second unit 10*b* can be prevented from migrating to the first unit 10*a*, and contamination of the first unit 10*a* is suppressed.

Herein, the suction device 7*b* is attached to the sidewall of the exit side of the second frame wall 5*b* of the second unit 10*b*. Therefore, contamination caused by the floating ink can be reliably suppressed by sucking in the floating ink by the suction device.

Furthermore, the recording medium 1 is guided upward in the gap passage S. Therefore, entering of the accompanying floating ink from the first unit 10*a* into the second unit 10*b* can be further suppressed.

In the ink-jet recording apparatus 100 according to the Present embodiment, printing onto both surfaces of the recording medium can be continuously carried out. Even in the case of a design that requires a large amount of ink application, the ink is dried by the first drying drum 3*a* and the second drying drum 3*b*; therefore, blurring of the image can be suppressed.

In the ink-jet recording apparatus 100, examples of the method of carrying the recording medium 1 thereinto include a method in which the recording medium 1 wound around a winding roll is carried into the ink-jet recording apparatus 100. Also, examples of the method of carrying out the recording medium therefrom include a method in which the printed recording medium is wound up by a winding roll.

The recording medium 1 used in the ink-jet recording apparatus 100 is not particularly limited to paper, film, metal foil, etc.

The inks used by the above described first ink-jet recording heads 2*a* and the second ink-jet recording heads 2*b* may be dyes or pigments, and the inks are not limited to be aqueous or oil-based.

Hereinabove, the embodiment of the present invention has been explained. However, the present invention is not limited to the above described embodiment.

For example, in the ink-jet recording apparatus 100 according to the present embodiment, the number of rows of the disposed heads of the first ink-jet recording heads 2*a* or the second ink-jet recording heads 2*b* is four; however, the number is not necessarily limited thereto.

The first ink-jet recording heads 2*a* and the second ink-jet recording heads 2*b* house inks; however, instead of the inks, agents such as glazing agents or flameproofing agents can be blown thereonto.

Industrial Applicability

The ink-jet recording apparatus of the present invention can be utilized as an apparatus that carries out printing onto both surfaces of a recording medium by an ink-jet method. According to the ink-jet recording apparatus, contamination of the recording medium can be suppressed, installation space can be efficiently utilized, and continuous printing onto the both surfaces of the recording medium can be carried out.

DESCRIPTION OF REFERENCE NUMERALS

1 . . . RECORDING MEDIUM
1*a*, 1*b* . . . SURFACES
10*a* . . . FIRST UNIT
10*b* . . . SECOND UNIT
100 . . . INK-JET RECORDING APPARATUS
2*a* . . . FIRST INK-JET RECORDING HEADS
2*b* . . . SECOND INK-JET RECORDING HEADS
3*a* . . . FIRST DRYING DRUM
3*b* . . . SECOND DRYING DRUM
4 . . . HOUSING SPACE
5*a* . . . FIRST FRAME WALL
5*a*1 . . . FIRST BOUNDARY WALL
5*b* . . . SECOND FRAME WALL
5*b*1 . . . SECOND BOUNDARY WALL
6*a*, 6*b* . . . GUIDING ROLLS
7*a*, 7*b* . . . SUCTION DEVICES
E1 . . . ENTRANCE
E2 . . . EXIT
S . . . GAP PASSAGE

The invention claimed is:

1. An ink-jet recording apparatus capable of carrying out printing continuously onto both surfaces of a recording medium, the ink-jet recording apparatus comprising:

a first unit having a first ink-jet recording head for carrying out printing onto a first surface of the recording medium and having a first drying drum positioned below the first ink-jet recording head and heating and drying the recording medium after the printing; and a second unit having a second ink-jet recording head for carrying out printing onto a second surface of the recording medium and having a second drying drum positioned below the second ink-jet recording head and heating and drying the recording medium after the printing; wherein the first unit and the second unit are adjacent to each other;

in the first unit, the first surface is subjected to the printing when the recording medium travels from the second unit side toward an opposite side;

in the second unit, the second surface is subjected to the printing when the recording medium travels from the first unit side toward an opposite side;

the recording medium can continuously travel in the first unit and the second unit;

a first boundary wall and a second boundary wall are provided between the first unit and the second unit; and a gap passage for allowing passage of the recording medium is provided in a part in which the first boundary wall and the second boundary wall overlap with each other.

2. The ink-jet recording apparatus according to claim 1, wherein a guiding roll immediately before guiding the recording medium to the gap passage can be moved up and down.

3. The ink-jet recording apparatus according to claim 1, wherein housing space is provided between the first drying drum and the second drying drum.

4. The ink-jet recording apparatus according to claim 3, wherein an ink tank is housed in the housing space, and an ink is supplied from the ink tank to the first ink-jet recording head and the second ink-jet recording head.

5. The ink-jet recording apparatus according to claim 1, wherein the first ink-jet recording head and the second ink-jet recording head are provided at a same height.

6. The ink-jet recording apparatus according to claim 1, wherein the first unit and the second unit both have a shape of a turned L and are symmetrical with respect to the first boundary wall and the second boundary wall.

7. The ink-jet recording apparatus according to claim 1, wherein a suction device is attached to each of an entrance-side sidewall of a first frame wall of the first unit and an exit-side sidewall of a second frame wall of the second unit.

* * * * *